US005144731A

United States Patent [19]

Sugie et al.

[11] Patent Number: 5,144,731

[45] Date of Patent: Sep. 8, 1992

[54] AUTOMATIC LAP PIECING METHOD AND AN APPARATUS FOR CARRYING OUT THE SAME

[75] Inventors: Tosio Sugie, Ogaki; Yoji Yamada, Ichinomiya; Seiji Kobori, Ogaki; Takaomi Hotta; Yasuhiro Serizawa, both of Shimada, all of Japan

[73] Assignees: Kabushikikaisha Hara Shokki Seisakusho, Gifu; Nisshinbo Industries, Inc., Tokyo, both of Japan

[21] Appl. No.: 476,499

[22] PCT Filed: Oct. 4, 1989

[86] PCT No.: PCT/JP89/01016

§ 371 Date: Jun. 8, 1991

§ 102(e) Date: Jun. 8, 1991

[87] PCT Pub. No.: WO91/05096

PCT Pub. Date: Apr. 18, 1991

[51] Int. Cl.[5] ..... D04H 1/08; D01G 15/40

[52] U.S. Cl. ..... 28/117; 19/115 A; 28/116

[58] Field of Search ..... 28/116, 117, 134; 19/115 A, 115 R, 229

[56] References Cited

U.S. PATENT DOCUMENTS

| | | | |
|---|---|---|---|
| 4,809,920 | 3/1989 | Bächinger | 28/103 X |
| 4,996,747 | 3/1991 | Wichtermann et al. | 19/115 R |
| 5,038,441 | 8/1991 | Mondini et al. | 19/115 R |

*Primary Examiner*—Werner H. Schroeder
*Assistant Examiner*—Bibhu Mohanty
*Attorney, Agent, or Firm*—Burns, Doane, Swecker & Mathis

[57] ABSTRACT

An automatic lap piecing method of piecing two lap sheets (2, 4) together, comprising the steps of holding the leading end (3) of the lap sheet (2) of a full lap (1) by a tubular member (6) by suction created in the suction opening (7) of the tubular member (6), shifting the tubular member (6) to a position where the leading end (3) of the lap sheet (2) can be superposed on the trailing end (5) of a preceding lap sheet (4), releasing the leading end (3) of the lap sheet (2) from the tubular member (6) to superpose the leading end (3) on the trailing end (5), and movign the tubular member (6) to smooth down the lap of the leading end (3) and the trailing end (5) to piece the two lap sheets (2, 4) together, and an automatic lap piecing apparatus capable of carrying out the automatic lap piecing method.

8 Claims, 7 Drawing Sheets

AUTOMATIC LAP PIECING METHOD AND AN APPARATUS FOR CARRYING OUT THE SAME

TECHNICAL FIELD

The present invention relates to an automatic lap piecing method to be carried out on a textile machine, and an apparatus for carrying out the same. More specifically, to a method of piecing together the trailing end of the lap sheet of a preceding lap and the leading end of the lap sheet of a succeeding full-lap, when the preceding lap is depleted in a textile machine such as a ribbon lap machine, a comber or the like, and an apparatus for carrying out such a method.

BACKGROUND ART

A textile machine, for example, a ribbon lap machine, is stopped and a pilot lamp is lit upon the depletion of the lap feeding a lap sheet to the ribbon lap machine. Upon observing the lit pilot lamp, the operator interrupts the present work and goes to the ribbon lap machine, or goes to the ribbon lap machine after completing the present work, removes an empty bobbin, supplies a full lap, unwinds the lap sheet of the full lap, superposes the leading end of the lap sheet on the trailing end of the lap sheet remaining on the plate, and smooths down the superposed lap sheets for piecing. Since a usual ribbon lap machine, in general, has six delivery units, the lap piecing procedure is repeated six times, the ribbon lap machine is inched until the leading ends of the new lap sheets pass the curl plates, respectively, and then the ribbon lap machine is restarted.

Therefore, a textile machine, such as a ribbon lap machine, has a disadvantage in that the efficiency of operation thereof is very low, and accordingly, an automation of the lap changing operation is urgently required. Although the removal of empty bobbins and the supply of full laps can be achieved successfully by the conventional automated means, neither a practically effective automatic lap sheet piecing method nor an automatic lap sheet piecing apparatus for automatic lap sheet piecing operation, which is the most important operation, has been proposed.

DISCLOSURE OF THE INVENTION

An object of the present invention is to provide an automatic lap sheet piecing method and an apparatus for carrying out the same, by which an automatic lap piecing operation, which has not hitherto been achieved, is accomplished.

The object of the present invention can be attained by an automatic lap piecing method comprising the steps of: attracting the leading end of a succeeding lap sheet of a full lap by suction with a tubular member provided with suction holes in the circumference thereof; moving the tubular member from a position near the full lap to a position corresponding to the trailing end of a preceding lap sheet, so that the leading end of the succeeding lap sheet is superposed on the trailing end of the preceding lap sheet; releasing the leading end of the lap sheet from the tubular member; and moving the tubular member so as to smooth down at least the superposed portions of the two lap sheets.

An apparatus suitable for carrying out the foregoing automatic lap piecing method comprises: a first driving device; a first driving shaft journaled on the frame of the textile machine and driven by the first driving device; a first transmission means mounted on the first driving shaft; a second transmission means comprising an input means interlocked with the first transmission means, and an output means kinematically interlocked with the output means; a second driving shaft movably supporting the input means, extended in parallel to a feed roller, and driven by a second driving device; a shaft extended in parallel to the second driving shaft, and supporting the output means; a second transmission means supporting member having one end movably supporting the shaft supporting the output means so that the axis of the shaft supporting the output means is able to revolve about the axis of the second driving shaft, and the other end fixed to the second driving shaft; at least one arm having one end fixed to the shaft supporting the output means, and the other end extending toward a circumferential surface of a full lap supported on a lap feeder; a tubular member fixed to the other end of the arm on the side of the lap so as to extend in parallel to the axis of the feed roller, and provided with a suction opening formed in parallel to its own axis; and a suction device connected to the tubular member to create a suction in the suction opening of the tubular member.

BEST MODE OF CARRYING OUT THE INVENTION

The present invention will be described in detail hereinafter with reference to the accompanying drawings showing an automatic lap piecing method in accordance with the present invention and an automatic lap piecing apparatus in a preferred embodiment according to the present invention.

Figure 1:
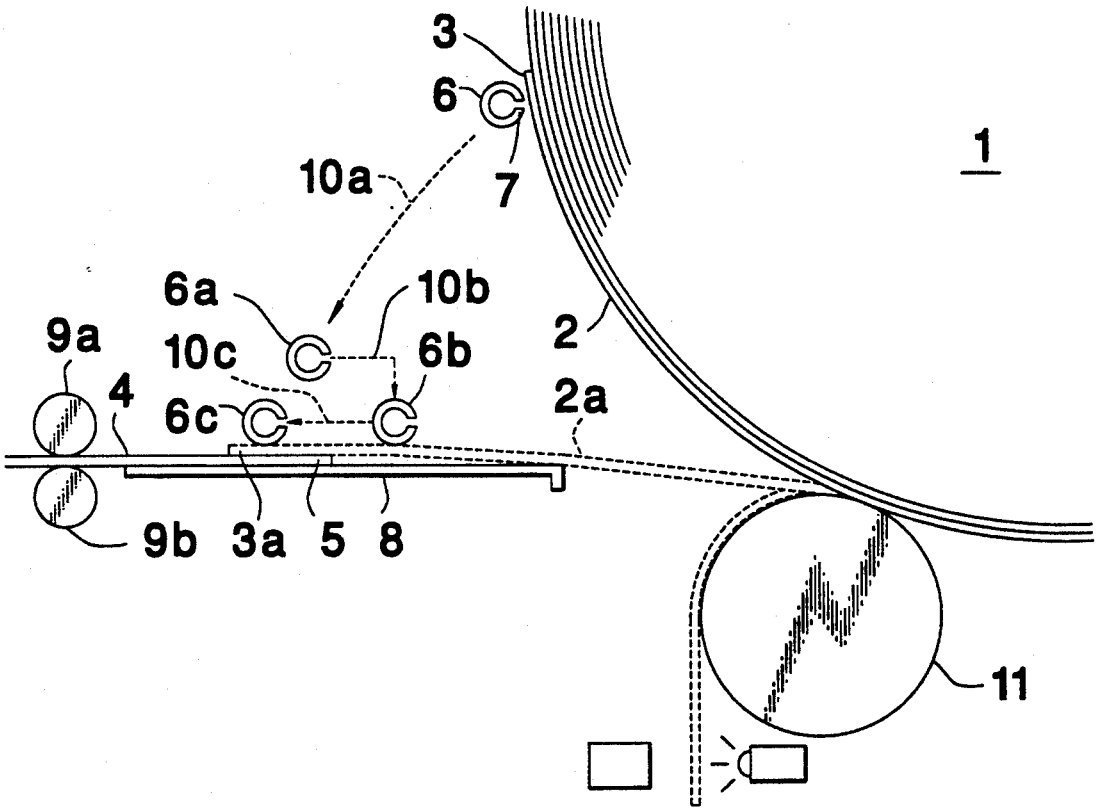
FIG. 1 is a view explaining an automatic lap piecing method in accordance with the present invention.

FIG. 1 is a view of explaining the automatic lap piecing method in accordance with the present invention. A full lap 1 is mounted on a pair of feed rollers 11 (only one of which is shown in FIG. 1) so that the leading end 3 of the lap sheet 2 of the full lap 1 is located opposite to a tubular member 6 provided with a suction opening 7. When carrying out an automatic lap piecing operation, a vacuum is created within the tubular member 6 to attract the leading end 3 of the lap sheet 2 to the suction opening 7 by suction, the tubular member 6 is moved along a path as indicated by an arrow 10*a* to a position 6*a* (FIG. 1) above a position near the trailing end 5 of a preceding lap sheet 4 extending on a plate 8, and then the suction of the tubular member 6 is nullified to superpose the leading end 3 of the lap sheet 2 on the trailing end 5 of the preceding lap sheet 4. Subsequently, the tubular member 6 is moved along a path as indicated by an arrow 10*b*, from the position 6*a* to a position 6*b* on the lap sheet 2 behind the trailing end 5 of the preceding lap sheet 4, and then the tubular member 6 is moved along the lap sheet 2 along a path as indicated by an arrow 10*c* to a position 6*c*, to move the tubular member to a portion 3*a* of the lap sheet 2*a* near the leading end. After the automatic lap piecing operation has been thus completed, the tubular member 6 is moved upward from the position 6*c*, and then a pair of back rollers 9*a* and 9*b* are driven for rotation to feed the lap sheet 2 overlapping the preceding lap sheet 4 to the processing mechanism, not shown, of the textile machine.

An automatic lap piecing apparatus in a preferred embodiment according to the present invention will be described with reference to FIGS. 2 and 5(A) to 5(H). The automatic lap piecing apparatus is provided with the tubular member 6 which is moved along the paths shown in FIG. 1 for an automatic lap sheet piecing operation.

Figure 2:
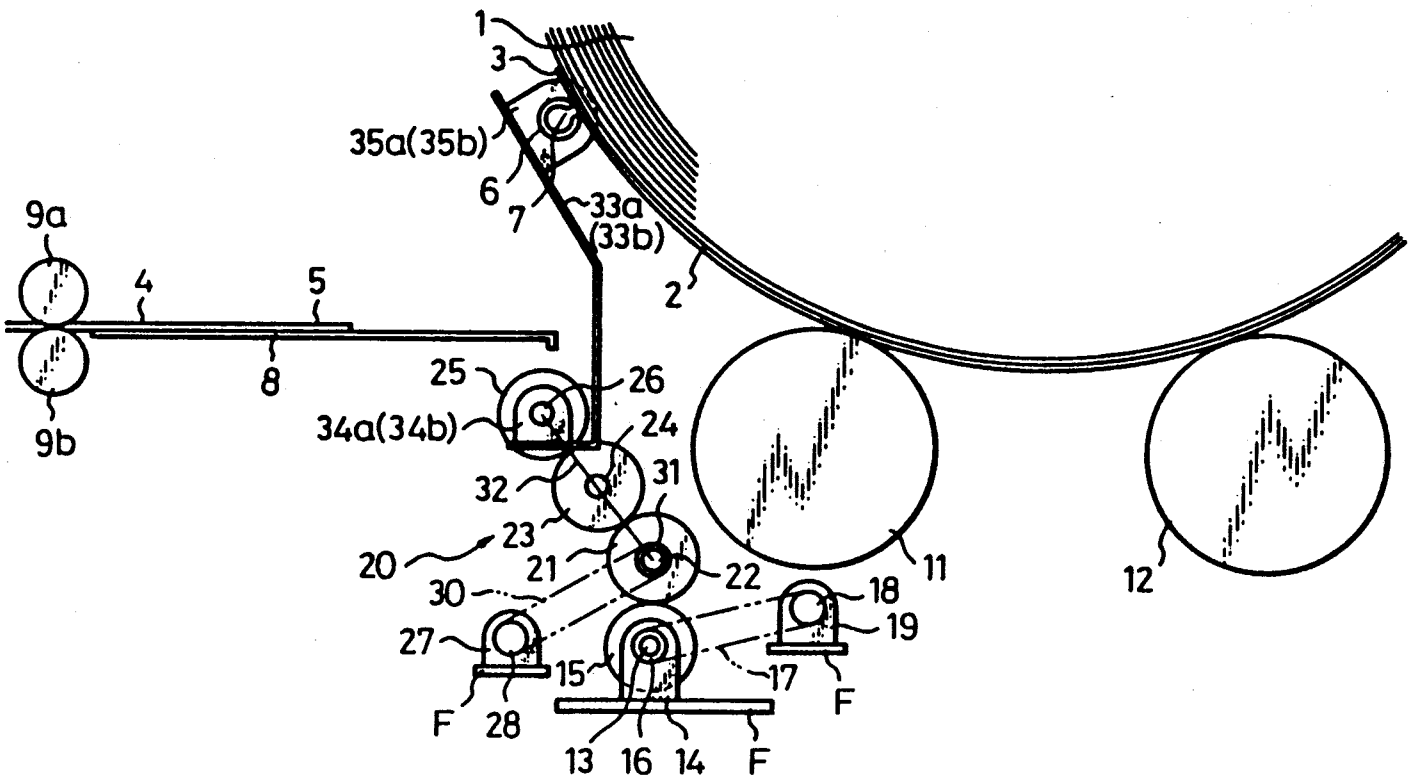
FIG. 2 is a schematic side elevation view illustrating an automatic lap piecing apparatus in a preferred embodiment according to the present invention in connection with a lap feeder and a plate.
Figure 3:
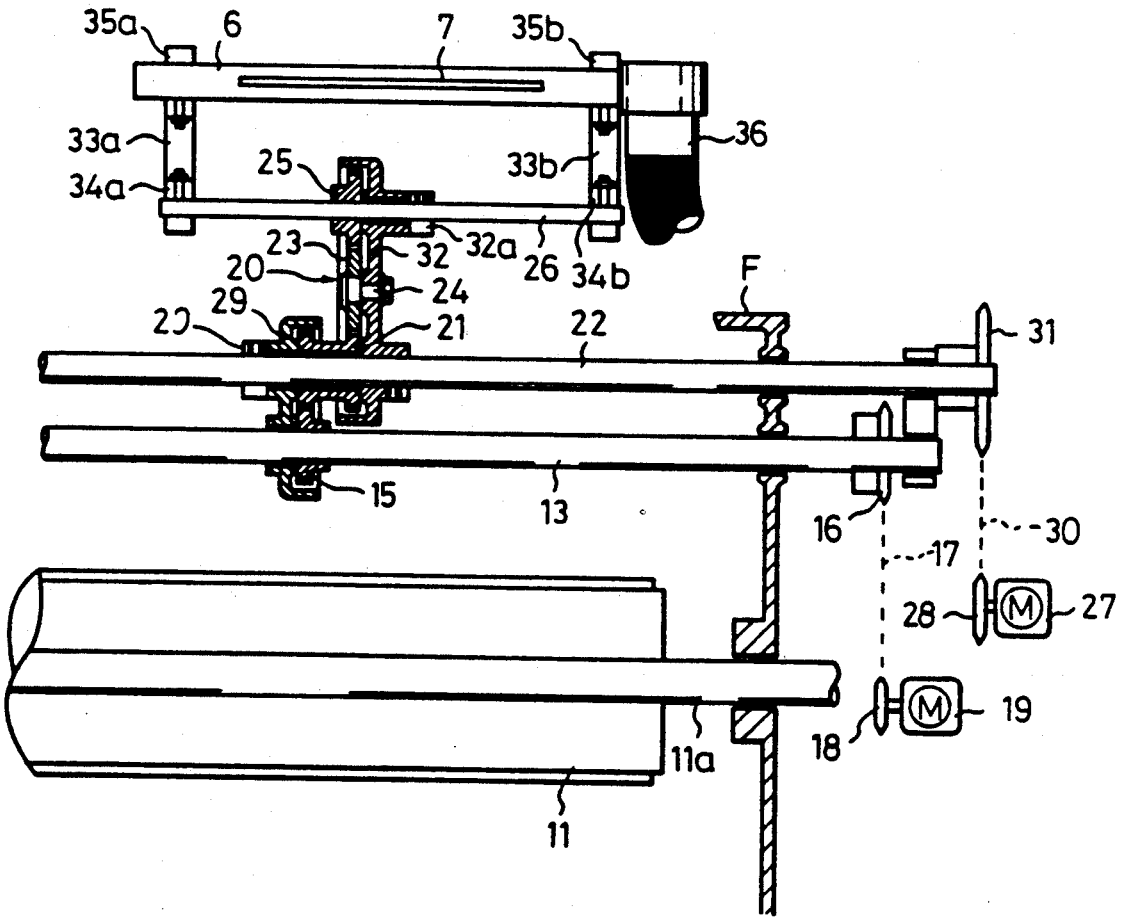
FIG. 3 is a front view illustrating a structure of the automatic lap piecing apparatus shown in FIG. 2.

FIG. 2 is a schematic side elevation view illustrating the automatic lap piecing apparatus in connection with a lap feeder and a plate, and FIG. 3 is a front elevation view illustrating a structure of the automatic lap piecing apparatus shown in FIG. 2.

The automatic lap piecing apparatus shown in FIGS. 2 and 3 employs gears as first and second transmission means, but the first and second means are not limited thereto; the first and second transmission means may be a chain drive or a linkage.

As best shown in FIG. 3, a shaft 11*a* supporting a front feed roller 11, a first driving shaft 13 and a second driving shaft 22 are each journaled on a frame F in parallel to each other by a suitable selected bearing mechanism (not shown). A chain 17 is extended between a sprocket 16 fixed to one end of the first driving shaft 13 and a sprocket 18 fixed to the output shaft of a first motor 19 to drive the first driving shaft 13 by the motor 19. Similarly, a chain 30 is extended between a sprocket 31 fixed to one end of the second driving shaft 22 and a sprocket 28 fixed to the output shaft of a second motor 27 to drive the second driving shaft 22 by the second motor 27.

A first gear 15, i.e., a first transmission means, is mounted fixedly on the first driving shaft 13. In this embodiment, the second transmission means 20 comprises a second gear (input means) 21, an intermediate gear 23 engaging the second gear 21, and a third gear (output means) 25 engaging the intermediate gear 23. The second gear 21 is journaled on the second driving shaft 22. A support arm 32 supporting the to the second driving shaft 22. The intermediate gear 23 is journaled on a shaft 24 attached to the support arm 32 at a position in the middle portion of the support arm 32. The third gear 25 is disposed above and engages the intermediate gear 23. The third gear 25 is fixedly mounted on a shaft 26. The upper end of the support arm 32 is joined to the shaft 26 for movement relative to the shaft 26.

A collar 32*a* is fixed to the shaft 26 to restrain the support arm 32 from axial sliding movement on the shaft 26. A cover 29 is supported on the first driving shaft 13 and the second driving shaft 22 so as to cover the first gear 15 and the second gear 21 and is restrained from axial sliding movement on the first driving shaft 13 and the second driving shaft 22 by a collar 29*a*.

In this embodiment, the respective lower ends of arms 33*a* and 33*b* are attached, respectively to collars 34*a* and 34*b* fixed respectively to the opposite ends of the shaft 26 so that the arms 33*a* and 33*b* extend in a direction perpendicular to the shaft 26. The tubular member 6 is fixed to brackets 35*a* and 35*b* attached to the upper ends, respectively, of the arms 33*a* and 33*b*. As shown in the drawing, the tubular member 6 is provided with a slit 7 parallel to its axis. The length of the slit 7 corresponds to the width of the lap to be used. A suction tube 36 is connected to one end of the tubular member 6 at its one end and to a suction device, not shown, at its other end.

In this automatic lap piecing apparatus of the present invention, the rotative motion of the first driving shaft 13 is transmitted by the first gear 15 through the gear train to the third gear 25 to turn the shaft 26, whereby the arms 33*a* and 33*b* are caused to swing to move the tubular member 6. As this time, the second driving shaft 22 swings the support arm 32 to revolve the shaft 26 supporting the third gear 25 around the second driving shaft 22, and consequently, the tubular member 6 is moved along a path generated by the combined action of the rotation of the third gear 25 caused by the rotation of the first gear 15 and the swing motion of the support arm 32 on the second driving shaft 22, namely, the revolution of the shaft 26 around the second driving shaft 22.

Figure 4:
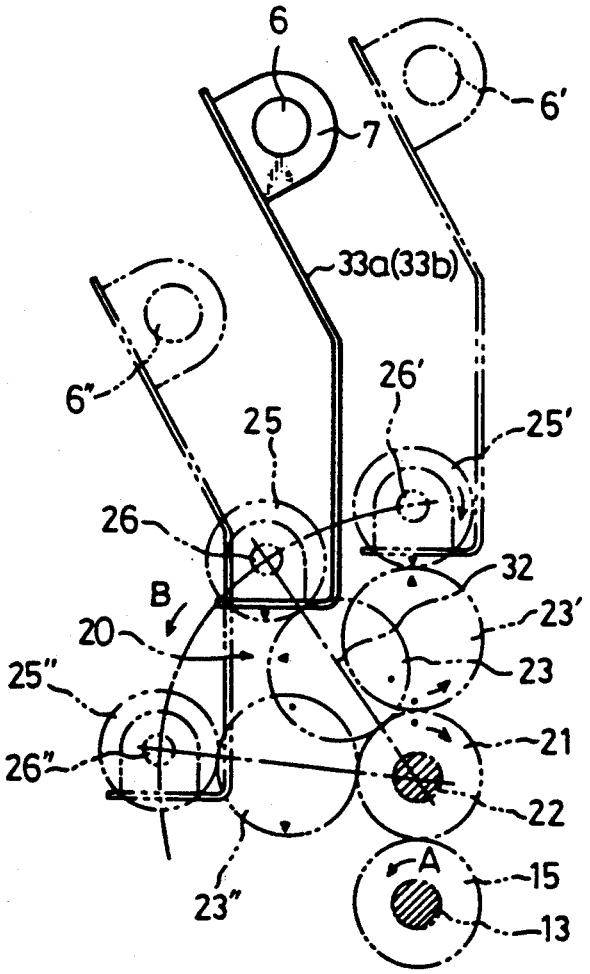
FIG. 4 is a diagrammatic view illustrating paths of a piecing pipe (6) included in the automatic lap piecing apparatus in accordance with the present invention, in connection with first and second transmission means.

Referring to FIG. 4 showing, by way of example, a path along which the shaft 26 and the tubular member 6 move, the third gear 25 is rotated clockwise through the second gear 21 and the intermediate gear 23 by the first gear 15 when the first gear 15 is rotated in a counterclockwise direction as indicated by an arrow A by the first driving shaft 13, and the same time, the second transmission means 20 and the support arm 32 are turned in a counterclockwise direction as indicated by an arrow B by the counterclockwise rotation of the second driving shaft 22. In FIG. 4, the corresponding positions on the second gear 21 and the intermediate gear 23 are indicated by circles, (○) and those on the intermediate gear 23 and the third gear 25 are indicated by triangles (Δ) to show clearly the relationship between the transmitting motions of the gears when the second shaft 22 is rotated while the first driving shaft 13 is held stationary. Thus, the tubular member can be moved, for example, along a path 6'→6 →6'' shown in FIG. 4 by the combined action of properly selected rotation of the first driving shaft 13 and the second driving shaft 22. Accordingly, the size and disposition of the component members of the automatic lap piecing apparatus of the present invention are determined selectively and the appropriate rotations of the first driving shaft 13 and the second driving shaft 22 are combined to move the tubular member 6 in a two-dimensional space along a desired path between a position near the circumference of the full lap supported on the lap feeder and a position near the trailing end of the preceding lap sheet lying on the plate.

The steps of the lap piecing operation of the automatic lap piecing apparatus of the present invention will be described sequentially with reference to FIGS. 5(A) to 5(H), in which only positions of the tubular member 6 relative to the full lap 1 and the plate 8 are shown for simplicity. In FIGS. 5(A) to 5(H), each of circles of a continuous line indicates the position of the tubular member 6 at the end of operation in each step, and each of circles of a broken line indicates the position of the tubular member 6 at the end of operation in the preceding step.

Figure 5A:
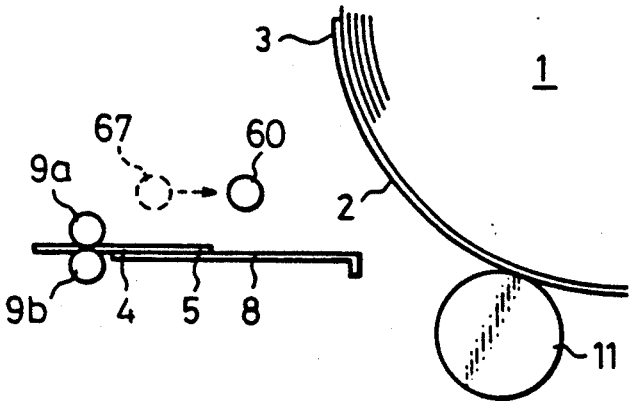
FIGS. 5(A) to 5(H) are views explaining steps of an automatic lap piecing operation to be carried out by the automatic lap piecing apparatus in accordance with the present invention.
Figure 5B:
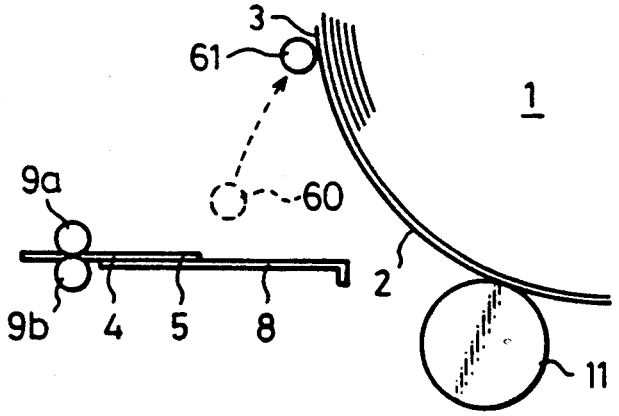
Figure 5C:
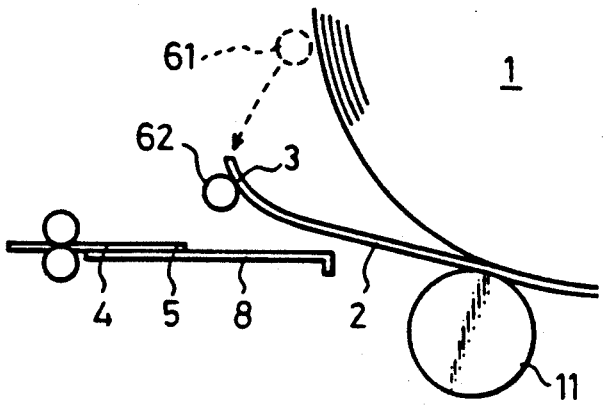
Figure 5D:
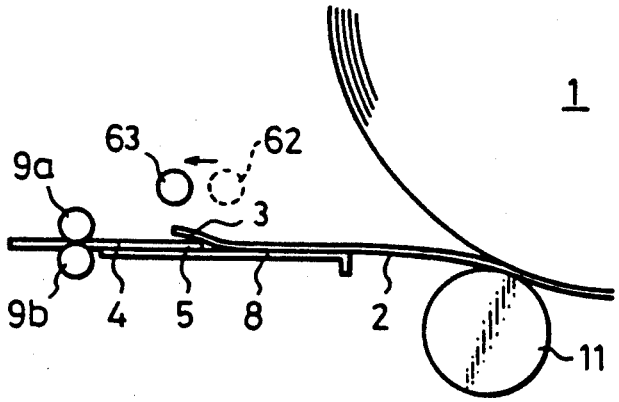
Figure 5E:
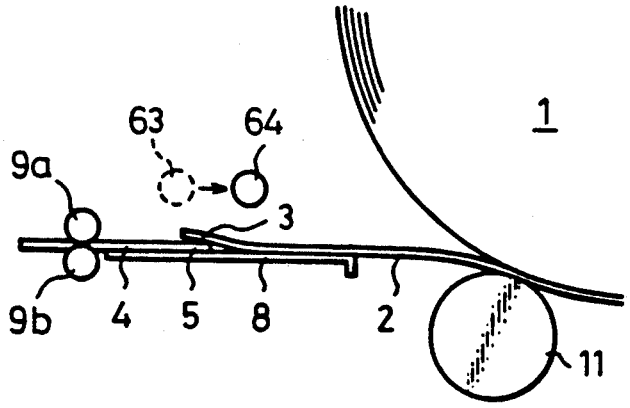
Figure 5F:
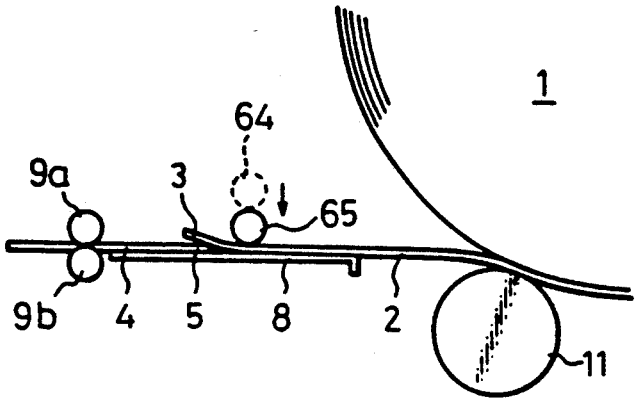
Figure 5G:
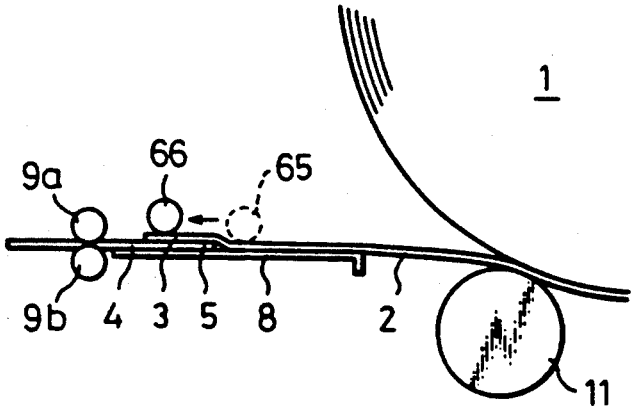
Figure 5H:
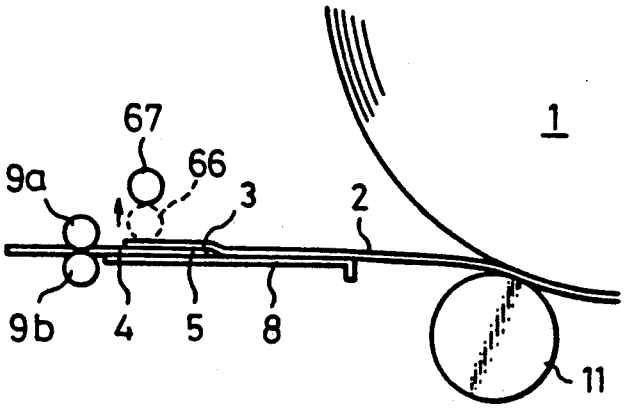

In FIG. 5(A), the tubular member 6 is at a standby position 60. In FIG. 5(B), the tubular member 6 has been moved from the standby position 60 to a position 61 and the tubular member 6 has attracted the leading end 3 of the lap sheet 2 by suction. In FIG. 5(C), the tubular member 6 holding the leading end 3 of the lap sheet 2 has been moved to a position 62 near the upper surface of the plate 8. At the position 62, the suction of the tubular member 6 is nullified. In FIG. 5(D), the tubular member 6 has been moved to the left, as viewed in FIG. 5(D), in parallel to the surface of the plate 8 from the position 62 to a position 63. As the tubular member 6 is moved from the position 62 to the position 63, the leading end 3 of the lap sheet 2 released from the tubular member 6 is superposed on the trailing end 5 of the preceding lap sheet 4. In FIG. 5(E), the tubular member 6 has been moved to the left, as viewed in FIG. 5(E), from the position 63 to a position 64. In FIG. 5(F), the tubular member 6 has been lowered from the position 64 to a position 65 on the lap sheet 2. In FIG. 5(G), the tubular member 6 has been moved again to the left along the lap sheet 2 to a position 66 to smooth down joining portion of the two lap sheets. The smoothing action of the tubular member 6 pieces together the two lap sheets neatly at the lap to complete the automatic lap piecing operation. In FIG. 5(H), the tubular member 6 has been lifted up from the position 66 to a position 67. Thereafter, the tubular member 6 is moved to the right from the position 67 to the initial, standby position 60 to complete one cycle of automatic lap piecing operation.

The automatic lap piecing apparatus of the present invention has been described with reference to FIGS. 2 and 3 by way of example only, and modifications thereof are possible. For example, as stated above, the gears for transmitting motions may be replaced by a linkage or a chain drive, and the motors may be replaced by pneumatic or hydraulic cylinder actuators. Preferably, a damper is provided between the suction tube and the suction device to regulate the flow of air through the suction tube. The damper ensures the quick and successful release of the leading end 3 of the lap sheet 2 from the suction pipe 6 and enables the use of the automatic lap sheet piecing apparatus of the present invention for removing a residual lap sheet from an almost depleted package.

Preferably, either the arm 33*a* or the arm 33*b* is a hollow member and the tubular member 6 is connected through the hollow member to the suction device. Also, preferably, the shape and/or the material of the arms 33*a* and 33*b* are determined so that the arms 33*a* and 33*b* may be flexed when the tubular member 6 can be brought softly into contact with the full lap 1 or the trailing end 5 of the preceding lap sheet 4 on the plate 8.

Preferably, the automatic lap sheet piecing apparatus is provided with a sensor as seen in FIG. 1 under a substantially horizontal tangent to the feed roller 11 to detect the lap sheet 2 which will depend from the feed roller 11 if automatic lap piecing operation is unsuccessful. The sensor prevents the restart of the textile machine if the lap sheet 2 of the full lap 1 had not been fed to the textile machine When desired, the operator may be notified of an unsuccessful automatic lap sheet piecing by suitable warning means such as a pilot lamp.

CAPABILITY OF EXPLOITATION IN INDUSTRY

As apparent from the foregoing description, according to the present invention, the leading- end of a lap sheet unwound from a full lap and the trailing end of a preceding lap sheet can be automatically and firmly pieced together, so that the efficiency of the operation of the textile machine is improved and the burden of the operator is lightened.

The automatic lap piecing apparatus in accordance with the present invention transfers the piecing pipe obliquely by the combined action of the rotative motions of the two shafts, so that the tubular member can be efficiently moved for a lap piecing action.

The employment of the two motors individually for driving the two driving shafts eliminates erroneous actions of the component members at stopping positions attributable to slip and transmission loss in a clutch, which is an essential component of a construction employing a single motor for driving two driving shafts, and a time loss attributable to a clutch changeover operation.

Furthermore, the use of the tubular member for both attracting the leading end of the lap sheet of a full lap by suction and smoothing down the lap of the two superposed lap sheets simplifies the automatic lap piecing apparatus, which facilitates the cleaning and maintenance of the textile machine, improves the safety of the cleaning and maintenance work, and improves the accessibility of the textile machine.

Moreover, when the motion transmission ratio (a gear ratio when a gear train is used or a linkage ratio when a linkage is used for transmitting motions from the second driving shaft to the third gear) between the second shaft and the third gear is fixed, the arms can be maintained at a given inclination during transference. On the other hand, the inclination of the arms varies according to the rotation of the second driving shaft when the motion transmission ratio is varied, and thus the tubular member can be moved obliquely only by the rotation of the second driving shaft to reduce the time necessary for shifting the tubular member and to further improve the accuracy of positioning the tubular member.

Still further, when the automatic lap piecing apparatus is used in combination with an automatic lap changing apparatus, a lap sheet can be cut at a desired position simply by operating a lap holding device in combination with the series of actions of the tubular member without the additional need for special devices or component parts, so that the apparatus is simplified and can be manufactured at a reduced cost.

We claim:

1. An automatic lap piecing method for piecing together a leading end of a lap sheet of a full lap and a trailing end of a preceding lap sheet when a lap is depleted on a textile machine, for processing laps successively fed thereto, said automatic lap piecing method comprising steps of:

attracting the leading end of the lap sheet of the full lap by suction with a tubular member having an axis and provided with suction holes in the circumference thereof;

moving the axis of the tubular member away from a position near the circumference of the full lap to a position corresponding to the trailing end of the preceding lap sheet so that the leading end of the lap sheet can be superposed on the trailing end of the preceding lap sheet;

releasing the leading end of the lap sheet from the tubular member; and moving the tubular member to smooth down at least the superposed portions of the two lap sheets.

2. An automatic lap piecing apparatus for automatically piecing together a leading end of a lap sheet of a new full lap and a trailing end of a preceding lap sheet on a lap processing textile machine comprising:

a lap feeder having a pair of feed rollers for feeding the lap sheet of a lap supported thereon, and a plate along which the lap sheet is fed to a lap sheet processing mechanism;

a first driving shaft journaled on a frame of the textile machine;

a first driving device for driving the first driving shaft;

a first transmission means mounted on the first driving shaft;

a second transmission means comprising an input means interlocked with the first transmission means, and an output means kinematically with the input means;

a second driving shaft extending parallel to the axes of the feed rollers and movably supporting the input means;

a second driving device for driving the second driving shaft;

a shaft extending parallel to the second driving shaft and supporting the output means;

a second transmission means supporting member having one end movably supporting the shaft supporting the output means so that the shaft supporting the output means can be revolved around the second driving shaft, and the other end fixed to the second driving shaft;

at least one arm having one end fixed to the shaft supporting the output means, and the other end extended toward the circumference of the full lap supported on the lap feeder, the other end of the arm being movable by the shaft from a position near the circumference of the full lap to a position near the plate;

a tubular member fixed to the other end of the arm on the side of the lap so as to extend in parallel to the axes of the feed rollers, and provided with a suction opening extending parallel to the axis of the tubular member; and a suction device connected to the tubular member to create a suction in the opening of the tubular member.

3. An apparatus according to claim 2, wherein said first transmission means is a first gear, said second transmission means comprises a second gear engaging the first gear, an intermediate gear engaging the second gear, and a third gear engaging the intermediate gear, and one end of the arm is fixed to a shaft supporting the third gear.

4. An apparatus according to claim 2, wherein said suction opening is a slit.

5. An apparatus according to claim 2, wherein a damper is provided between said tubular member and said suction device to regulate the suction of the tubular member.

6. An apparatus according to claim 2, wherein the arm supporting the tubular member is capable of being elastically flexed for a cushioning action when the tubular member is brought into contact with the lap or the plate.

7. An apparatus according to claim 2, wherein said arm supporting the tubular member is a hollow member, and said suction device is connected through the arm to said tubular member.

8. An apparatus according to claim 2, wherein a sensor for detecting a lap is provided to detect the lap when the lap piecing operation is unsuccessful, and the sensor is adapted to inhibit the textile machine from operating when the lap piecing operation is successful.

* * * * *